US005433678A

United States Patent [19]

Chi

[11] Patent Number: 5,433,678

[45] Date of Patent: Jul. 18, 1995

[54] DYNAMIC RESISTANCE SYTEM FOR AN EXERCISER MACHINE

[76] Inventor: Wu H. Chi, No. 1-2, Lane 975, Chun-Jih Road, Tao-Yuan City, Taiwan

[21] Appl. No.: 359,643

[22] Filed: Dec. 20, 1994

[51] Int. Cl.[6] ..... A63B 21/00

[52] U.S. Cl. ..... 482/1; 482/99; 482/115; 482/903

[58] Field of Search ..... 482/1-9, 482/99, 102, 115-119, 903; 601/22, 23

[56] References Cited

U.S. PATENT DOCUMENTS

| | | | |
|---|---|---|---|
| 4,979,733 | 12/1990 | Prud'Hon | 482/116 X |
| 5,180,348 | 1/1993 | Saarinen | 482/903 X |
| 5,304,104 | 4/1994 | Chi | 482/1 |
| 5,360,382 | 11/1994 | Chi | 482/1 |

*Primary Examiner*—Richard J. Apley
*Assistant Examiner*—Glenn E. Richman
*Attorney, Agent, or Firm*—Morton J. Rosenberg; David I. Klein

[57] ABSTRACT

This invention relates to a device that uses the linear relationship between the electric current and the torque of the D.C. motor to simulate the effect of a weight stack of exercise machines. The motor produces a stable clockwise torque through the output shaft when a constant current is passing through it. When the user exerts a counterclockwise force which causes the motor to turn in a counterclockwise direction so that the electric current to the motor is controlled and maintained to deliver a stable torque from the motor against the counterclockwise force. Thus, the invention can replace conventional weight stacks used in exercise machines. The improvements and modifications made to the design have been focused on the problems of the system's inertia and friction during the cable rewinding on light loads. The invention features a torque switch mounted between the main shaft and winding drum, a winding mechanism assembled on the rear end of the main shaft and a roller clutch disposed inside the timing pulley. As a result, the cable speed can keep up with the exereise pace of the user, better simulating the feel of an exercise machine and the cable can rewind rapidly under any condition without slippage or breakdown.

3 Claims, 10 Drawing Sheets

DYNAMIC RESISTANCE SYTEM FOR AN EXERCISER MACHINE

BACKGROUND OF THE INVENTION

1. Field of the Invention

This invention relates to a device that utilizes the linear relationship between the electrical current and the torque of the D.C. motor to simulate the effect of a weight stack of exercise machines. Its simple construction, ease in adjustment and noiseless operation and the ability to change its load and to program the exercise curve through an electronic controller making exercise easier and more comfortable.

2. Prior Art

But relating to the prior art (U.S. Pat. No. 5,304,104), same defects still exist:

1. When the load is low, the loss of system's inertia and friction causes the rewinding of cable slowdown or even stopped, therefore simulation of the feel of conventional weight stack and other exercise devices is not attainable.
2. When the system power is turned off or when the power is broken down during use, slack of the cable appears as the motor loses its rewinding force which can easily result in the cable slipping off the spiral groove of the winding drum.

SUMMARY OF THE INVENTION

The objective of this invention is to overcome the system's inertia and friction. By means of a specially designed torque switch located in the winding drum enabling a quick ON-OFF response, the linear speed of the cable can keep pace with the exercise speed of the user and result in a better exercise feel and greater comfort.

It is also an object of the present invention to overcome the slack of the cable when power is turned off or broken down. An improved assembly with a plate shaped spiral spring which creates a certain counterclockwise torque transferred to the winding drum throuth the main shaft giving the cable a constant tension. The roller clutch inside the timing pulley at the front end of the main shaft will overrun during the rewinding of the main shaft. Thus, the winding drum can retrieve the cable quickly without slipping off the winding drum.

BRIEF DESCRIPTIONS OF THE DRAWINGS

DETAILED DESCRIPTION OF THE PREFERRED EMBODIMENT

Figure 1:
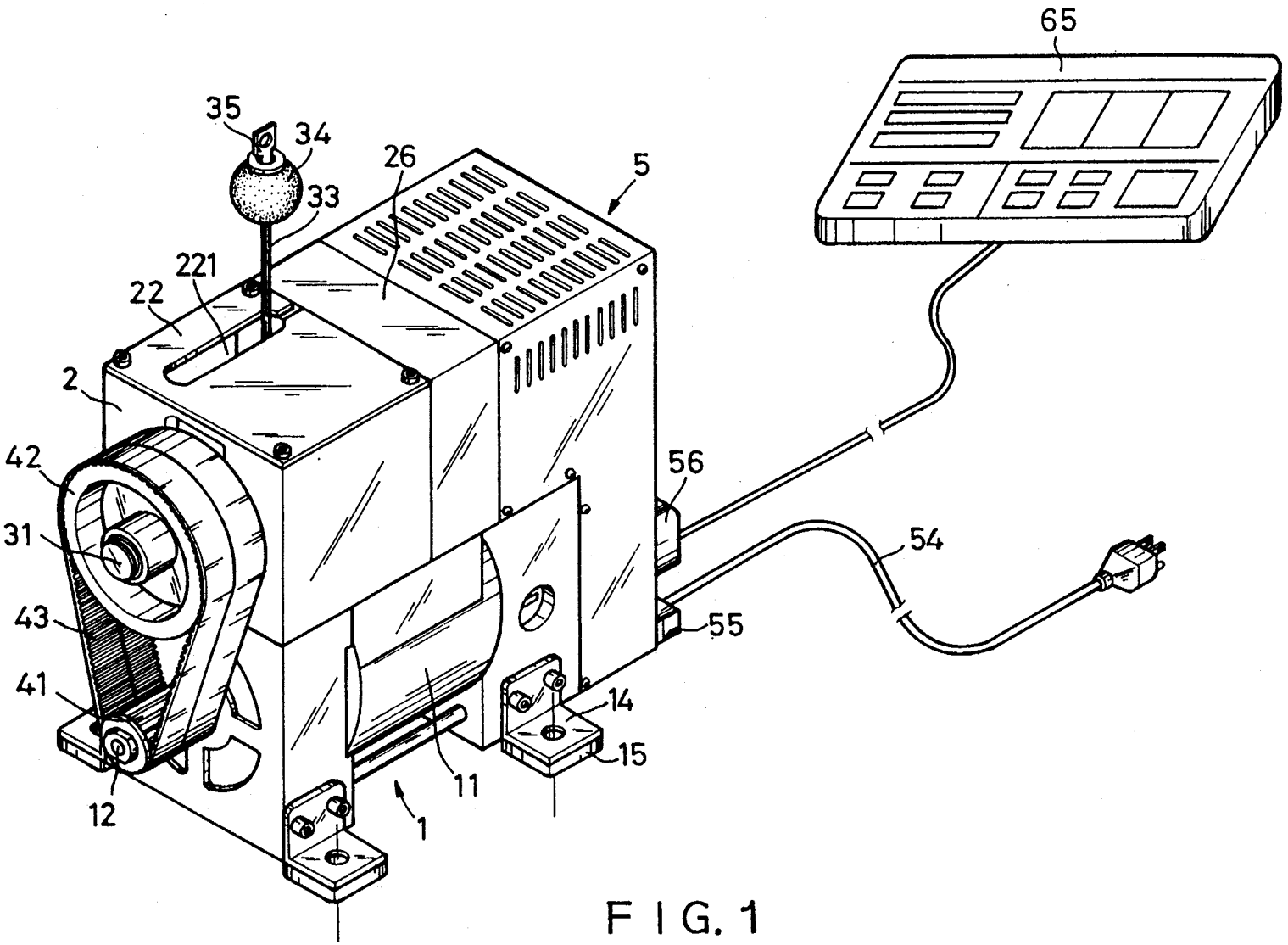
FIG. 1 is a perspective view of the invention's preferred embodiment.

Refer to FIG. 1, 2, 3, the dynamic resistance system comprises a driving device 1 consisting of a D.C. motor 11, a motor output shaft 12. A small electric motor fan can be disposed at the rear of said motor 11 to remove the heat generated by motor 11.

A bracket frame 2 is attached to motor 11 by means of screw member 21. The upper portion of motor 11 is mounted to a stopping bracket 22. Stopping bracket 22 is provided with a slotted hole 221. The front of bracket frame 2 is provided with a shaft hole 23 for disposal of the bearing 24. The rear of bracket frame is provided with a large hole 25. A rear cover 26 is attached to the hole 25 of the rear side of bracket frame by means of screw members 27. The shaft hole 261 of said bracket frame 2 is provided for disposal of bearings 28. The small hole 262 of said bracket frame 2 is provided for the insertion of slotted optical switch 29.

A winch 3 is mounted inside bearings 24, 28 of said bracket frame 2 and rear cover 26 and comprises of main shaft 21, winding drum 32 rotating along with main shaft 31, a cable 321 affixed to the winding drum 32 and wound around the inside of spiral slot 321 of winding drum 32. A rubber ball 34 is affixed to cable 33 is inserted through the free area of the slotted hole 221 of the stopping bracket 22.

A reduction device 4 comprising:

- a timing pinion 41 mounted on the said output shaft 12;
- a timing pulley 42 mounted on the front end of said winch 3;
- a timing belt connected to said timing pinion 41 and timing pulley 42 transmitting the torque of the motor to the output shaft 12 and thereby driving the winch 3;
- a controller box 5 that front housing 51 and rear housing 52 are assembled together at the rear of motor 11 by means of screw members 53 and that contains the said small electric cooling fan 13 and controlling circuit device 6, a power cord 54 and control panel 65 connected at sockets 55, 56 at the rear side of said controller box 5.

Figure 6:
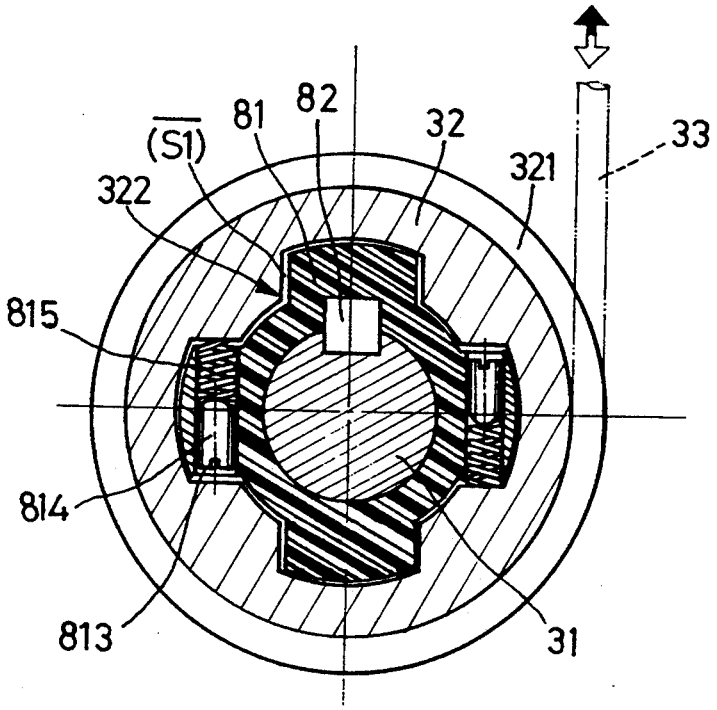
FIG. 6 is a cross sectional view along the line 6—6 of FIG. 5.

The aforementioned construction is for the most part identical to previous applications. The modification to the invention comprises of a torque switch 8 positioned inside the winding drum 32, a winding device 9 mounted on the rear end of main shaft 31 and a roller clutch 45 affixed to the inside the timing pulley 42. By means of the above,the dynamic resistance system has made a comprehensive improvement in the faults of the previous system in respect to the slow cable speeds under light loads and incomplete winding during power interrupt. Moreover, the dynamic resistance system has overcome the problems of system's inertia and friction thereby allowing the cable speed to keep pace with the user. Please refer to FIGS. 3, 4, 5, 6, and 7, the torque switch 8 chiefly positioned within winch 3 is primarily comprises:

- a cross shaped body 81 whose shaft hole 811 is provided with a key slot 812 that is positioned in the center part of the main shaft and outer edges are cut into the shape of a cross, said key slot 812 positioned with cross shaped slot 322 within the winding drum 32, a space (S1) reserved between the cross shaped body and the cross shaped slot 322 (as shown in FIG. 6), screw holes 813 positioned in the said cross shaped body for insertion of screw members 814 and small springs 815;

Ball bearings 83*a* and 83*b* positioned at the front and rear ends of cross shaped body 81 and fixed in place by means of a C-shaped ring 831;

a insulator 84 takes the shape of cross, a shaft hole 841 on said insulating body provided with key slot 842, said insulator 84 is fixed into place on the rear part of main shaft 31 by means of locking key 843, a space (S2) is reserved between winding drum 32 and cross shaped slot 322;

a L-shaped conducting strip 85 is affixed to the side of insulating body 84;

a decoding wheel 86 is provided with a gap (S4) in the front between the main shaft 31 therein the main shaft does not come into contact with separation ring 861, said separation ring 861 attached to insulator 84 by means of screw members 862, said separation ring 861 extends outward towards the outer edges of said decoding wheel 86, an insulating washer 8611 is disposed on decoding wheel 86 and the outer edges of said insulating washer positioned on main shaft 31 using a C-shaped ring 863, a gap (S3) must be maintained between separtation ring 861 and the winding drum 32;

a screw-shaped contact element 87 disposed with a steel ball 871 at its front, said contact element 87 is screwed into screw hole 324 at notch 323 on the rear edge of winding drum 82; therein, the steel ball 871 of the said contact element 87 extends into cross shaped slot 322 in the winding drum 82 opposited the conducting strip 85 on the side edge of insulator 84; a signal transfer element 88 comprising of an insulating body 881 affixed to the rear end of main shaft 31 by means of the screw holes 825, a conducting strip 882 positioned inside said insulating body 881, screw holes 8821 disposed on the conducting strip 882 to which is positioned a contact element 883 fitted with a steel ball 8831 on its tip, an electric wire 884 soldered onto the conducting strip 882 at one end and the free end 8841 of said electric wire is passed through the screw hole 325 on main shaft 31 extending out slot 326 of main shaft 31 and thereby connected to screw member 862 disposed in conducting strip 85.

Figure 10:
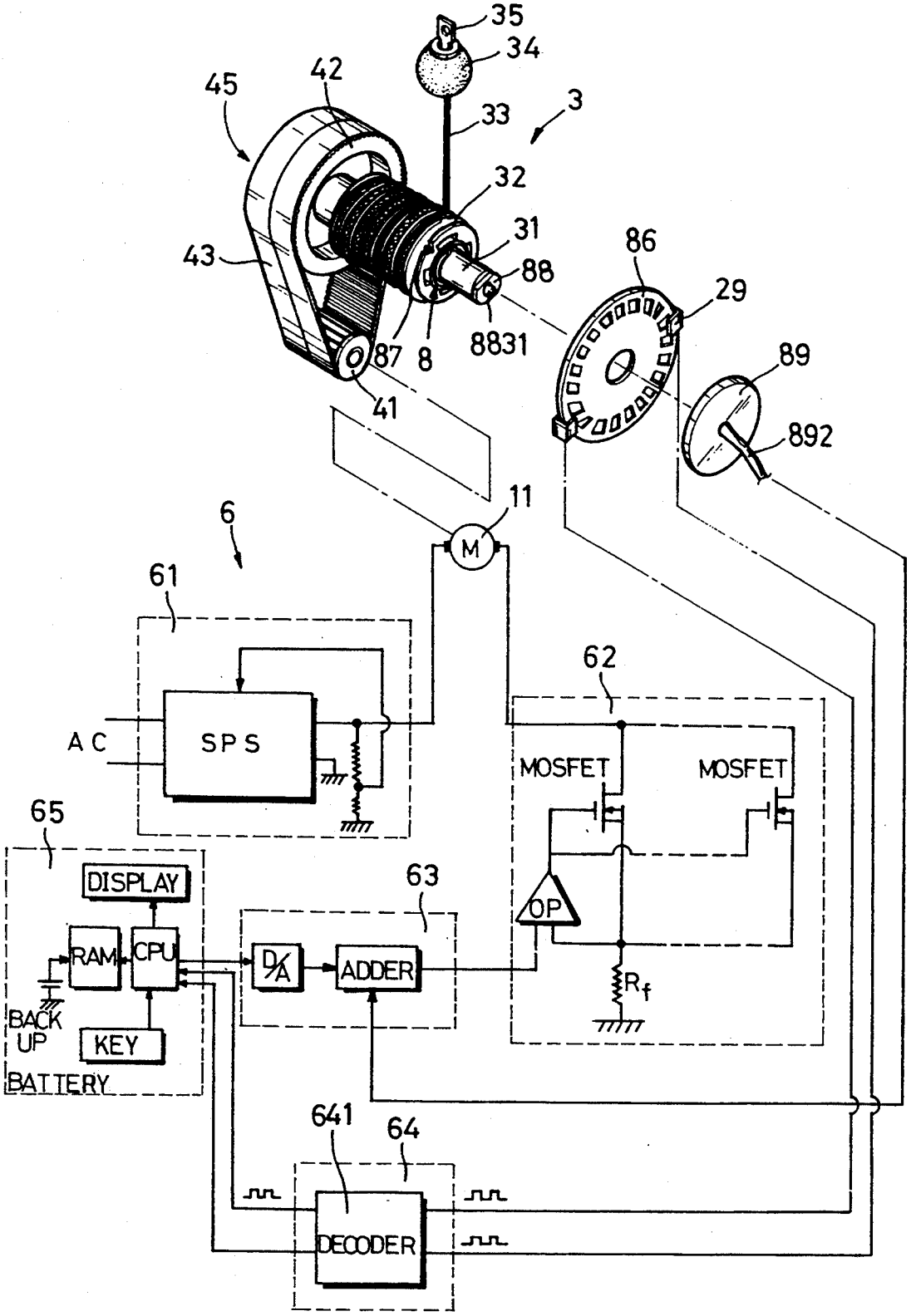
FIG. 10 is a schematic view of the circuit layout of the controller.

Through the assembly of the aforementioned components, the torque switch is disposed within the winding drum 32. During assembly, the small springs 815 on both sides of cross shaped body 81 should be set by means of the embedded screws 814 inside the cross shaped piece within said winding drum 82 as in FIG. 6 creating a forward torque on said winding drum 32. When the user exercise with light loads, said cable is pulled out rotating the winding drum in a reverse direction passing through the cross shaped body inside said torque switch to drive said main shaft 31. At this time, the tension of cable 33 causes the torque of winding drum 32 to be greater than the pre-set torque of the small springs 815 inside said cross shaped body 81 as shaown in FIG. 7. Contact element 87 mounted on the rear end of said winding drum 32 is not in contact with conducting strip 85 on insulator 84. When the cable slackens, cable 33 on winding drum 32 creates a torque smaller than the pre-set torque value of torque switch 8 thereby the steel ball 871 of conducting element 87 and conducting strip 85 are in a state of contact. A signal is fedback through the signal transmitter to the controller circuit device thereby the current of the motor will be compensated with a certain values as shown in FIG. 10.

Referring back to FIG. 2, a set of needle bearngs 44 and a set of roller clutches 45 are inserted withn the timing pulley 42 allowing drum 32 to revolve in a counter clockwise direction when the cable 33 is pulled out. The roller clutch 45 drive the timing pulley therein driving the timing belt 43 and the timing pinion then in turn driving the armature of motor 11.

Figure 2:
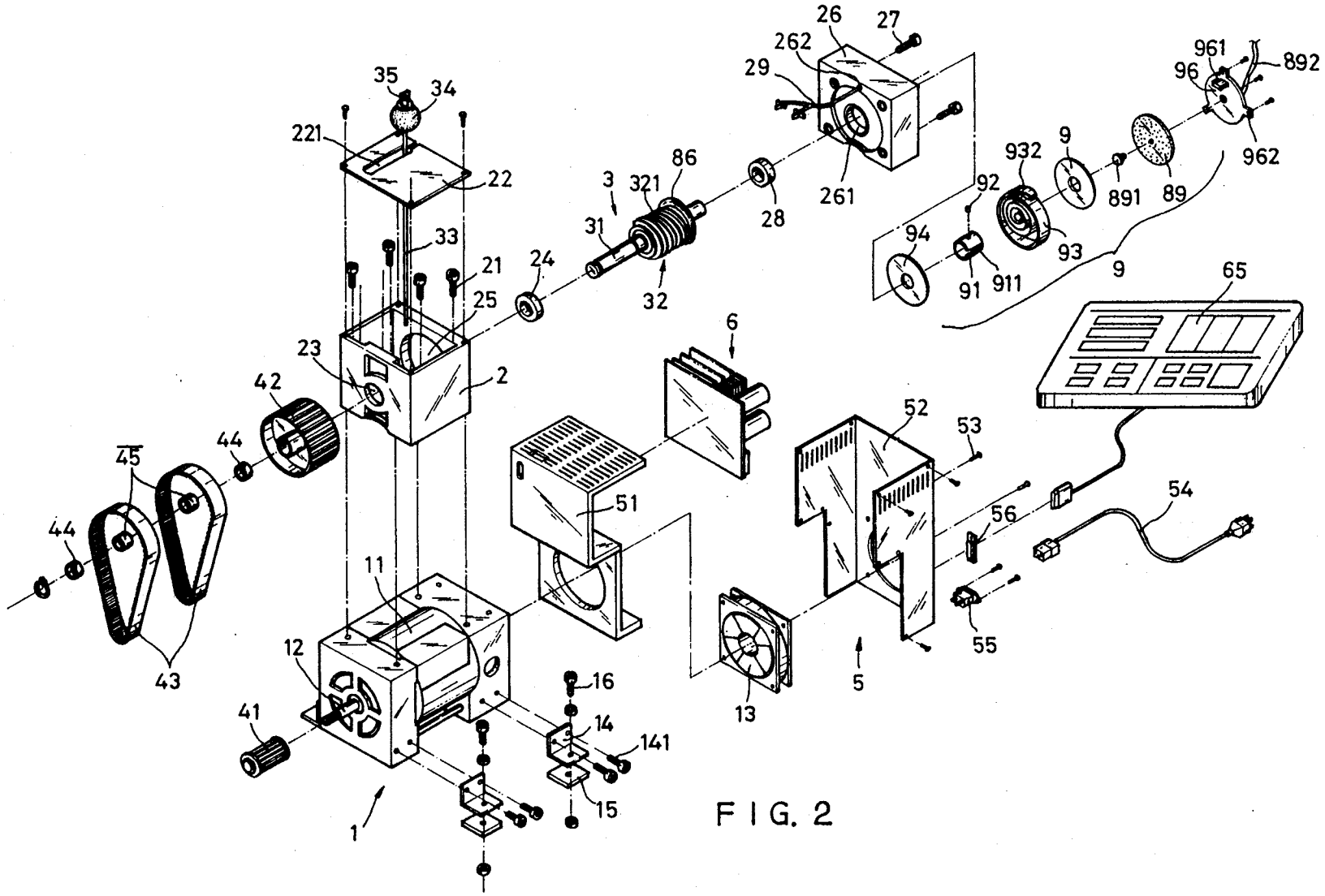
FIG. 2 is an exploded perspective view of the invention's preferred embodiiment.
Figure 3:
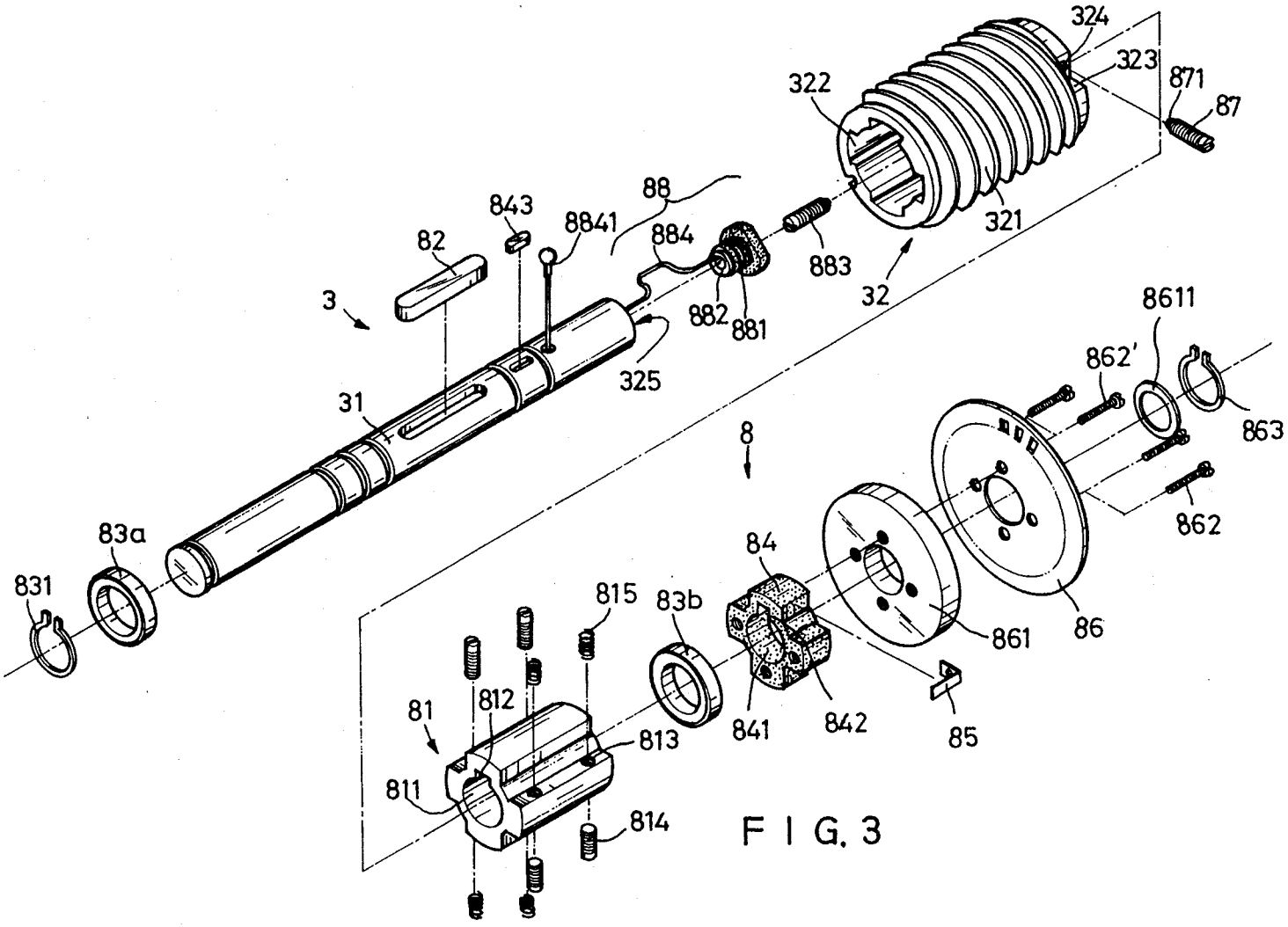
FIG. 3 is a exploded perspective view of the torque switch.
Figure 4:
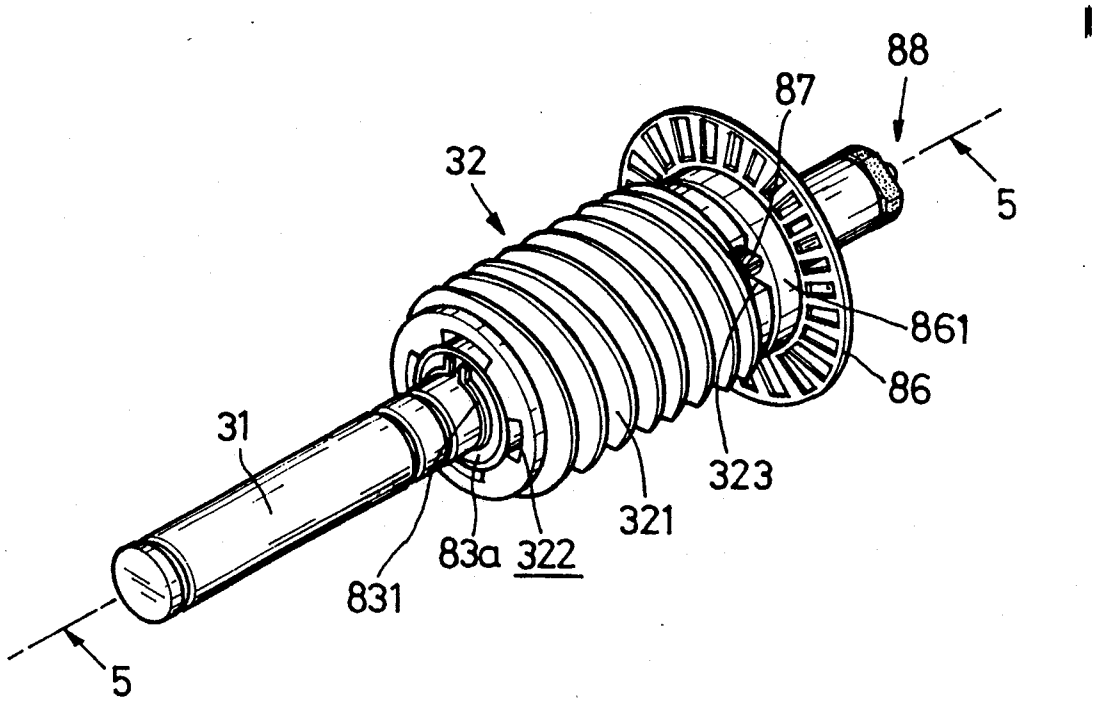
FIG. 4 is an assembled perspective view of the torque switch.
Figure 8:
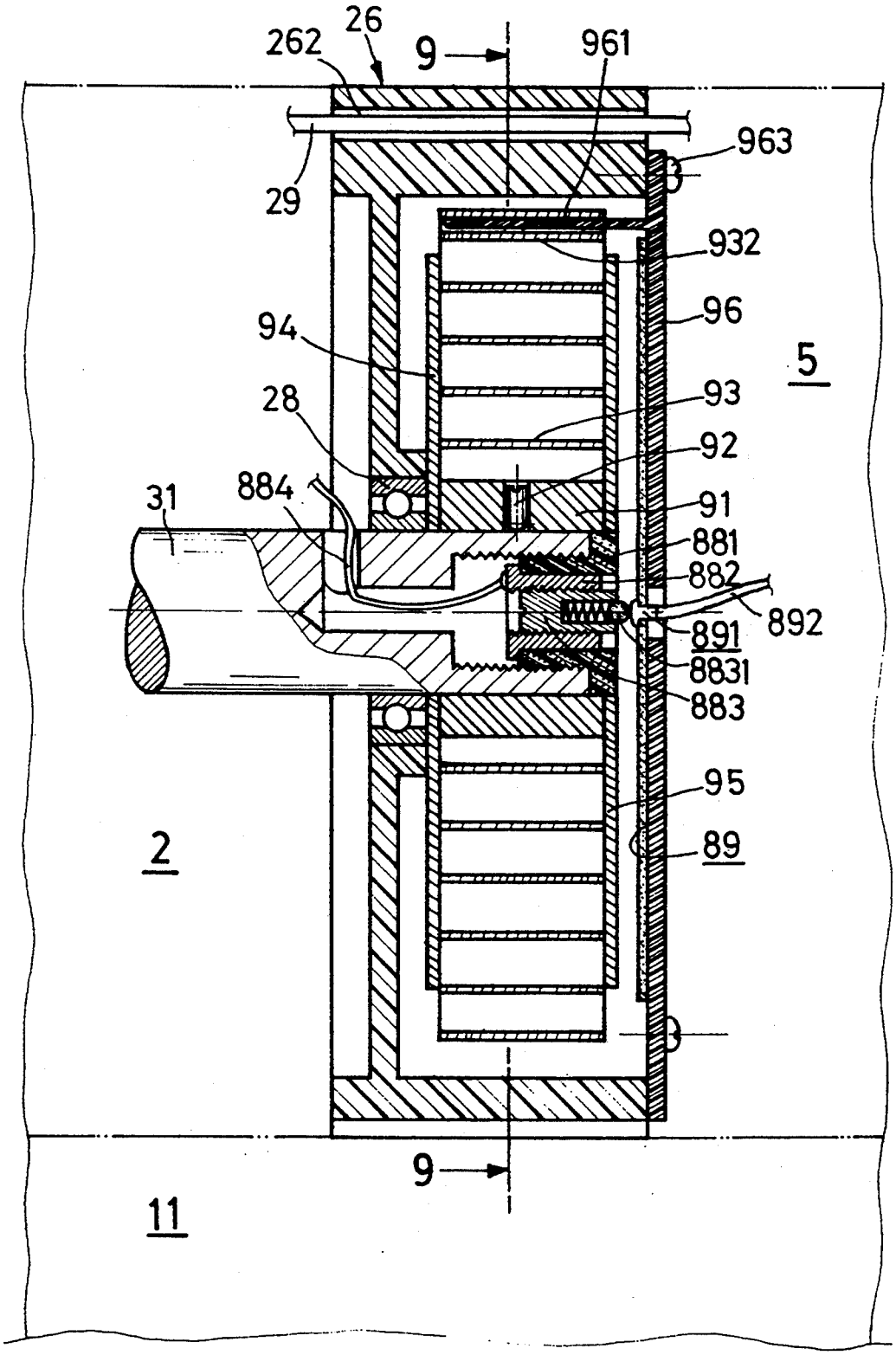
FIG. 8 is an assembly schematic view of the plate shaped spiral spring.
Figure 9:
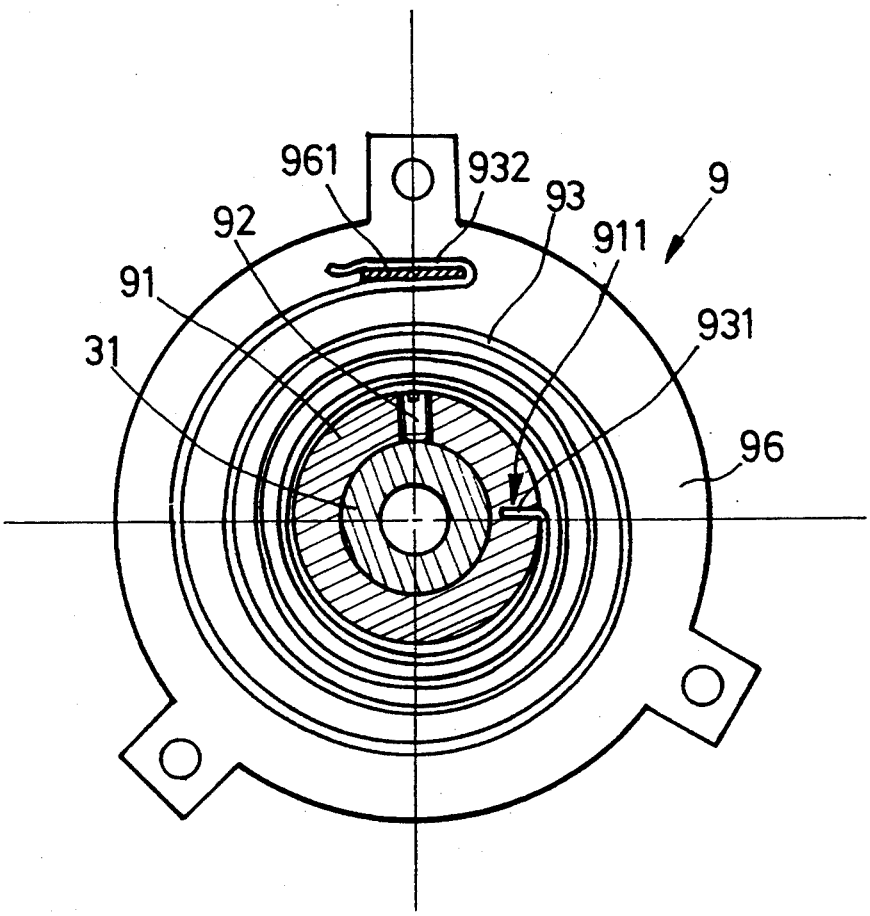
FIG. 9 is a cross sectional view along the line 9—9 of FIG. 8.

Referring to FIG. 8, 9, and also FIG. 2, the dynamic resistance system is incorporated with a winding device 9 affixed to the rear end of the main shaft to ensure that the cable rewinds back onto the winding drum comprising of:

a sleeve 91 disposed with a notched recess 911 wherein the said sleeve 91 can be affixed to the rear section of main shaft 31 by means of an adjustable bolt 92;

a spiral spring 93 disposed at the said notched recess 911 the inner edge of its rear section and a hook 932 is formed at its outer edges;

front and rear covers 94, 95 positioned at the front and rear of spiral spring 93;

a cover 96 disposed with a stopping tab 961 attached by means of a hook 932 on spiral spring 93.

As above described positioning holes 962 and screw members 963 of positioing cover 96 are used to fix said positioning cover 96 to rear housing 26. When the main shaft 31 is rotated by cable 33, the spiral spring is forced to contract and applies a reverse torque upon sleeve 91 and main shaft 31 therein transferred to winding drum 32 pulling the cable 33 with a constant force. Moreover, the roller clutch 45 within timing pulley 42 will overrun during the rewinding of the main shaft and thereby remains the armature of the motor stalled.

As shown in FIGS. 2 and 8, the inside edge of said cover 96 is affixed with an insulator 89, the center of insulator 89 is positioned with a conducting contact point 891 which comes into contact with steel ball 8831 on signal transfer device 88 thereby transferring the ON-OFF feedback signal of torque switch 8 through electric wire 884 to the conducting contact point 891, then on through conducting wire 892 to the controlling circuit device 6. The special characteristics of this design allows the feedback signal transmitted to be completely insulated from the main shaft 31, winding drum 32 and other metallic parts by means of the insulators 81,881 and insulating plate 89 resulting in the signal being accurately transmitted to controlling circuit device 6.

Referring to assembly layout in FIG. 10, the improved portion of controlling circuit device 6 of the dynamic resistance system comprises a variable voltage switching power supply (SPS) 61; an electronic load 62 made up of power MOSFETS, a feedback control signal processor composed of a digital-to-analog converter (D/A) and an adder; a motion sensor 64 including a decoding wheel 86, a slotted optical switch 29 and a signal decoder 641 and a control panel 65 composed a central processing unit (CPU), random access memory (RAM), a display and a key pad. The principles and operation conditions of the controlling circuit device 6 is that the SPS 61 converts alternating current to direct current and sends it to motor 11. The direct current voltage can be adjusted automatically according to the load conditions of motor 11; therein, the electric current passes through motor 11 to said electronic load 62 controlling the current constant of said motor 11. The electronic load is composed of power MOSFETS parallel connected, an operational amplifier (OPAMP) and a feedback resistor (RF). The feedback control signal processor converts the signal from CPU of the control panel through a digital/analog converter. The torque switch signal and the D/A output signal are combined together by an adder to drive the electronic load. Furthermore, a decoding wheel 86 driven by the main shaft 31 on winch 3 sends a train of pulses produced by the slotted optical switchs 29 onto a decoder 641. The forward and the reverse pulses are separately sent from said signal decoder 641 to control panel to display the exercise range of motion.

Figures 5, 5A:
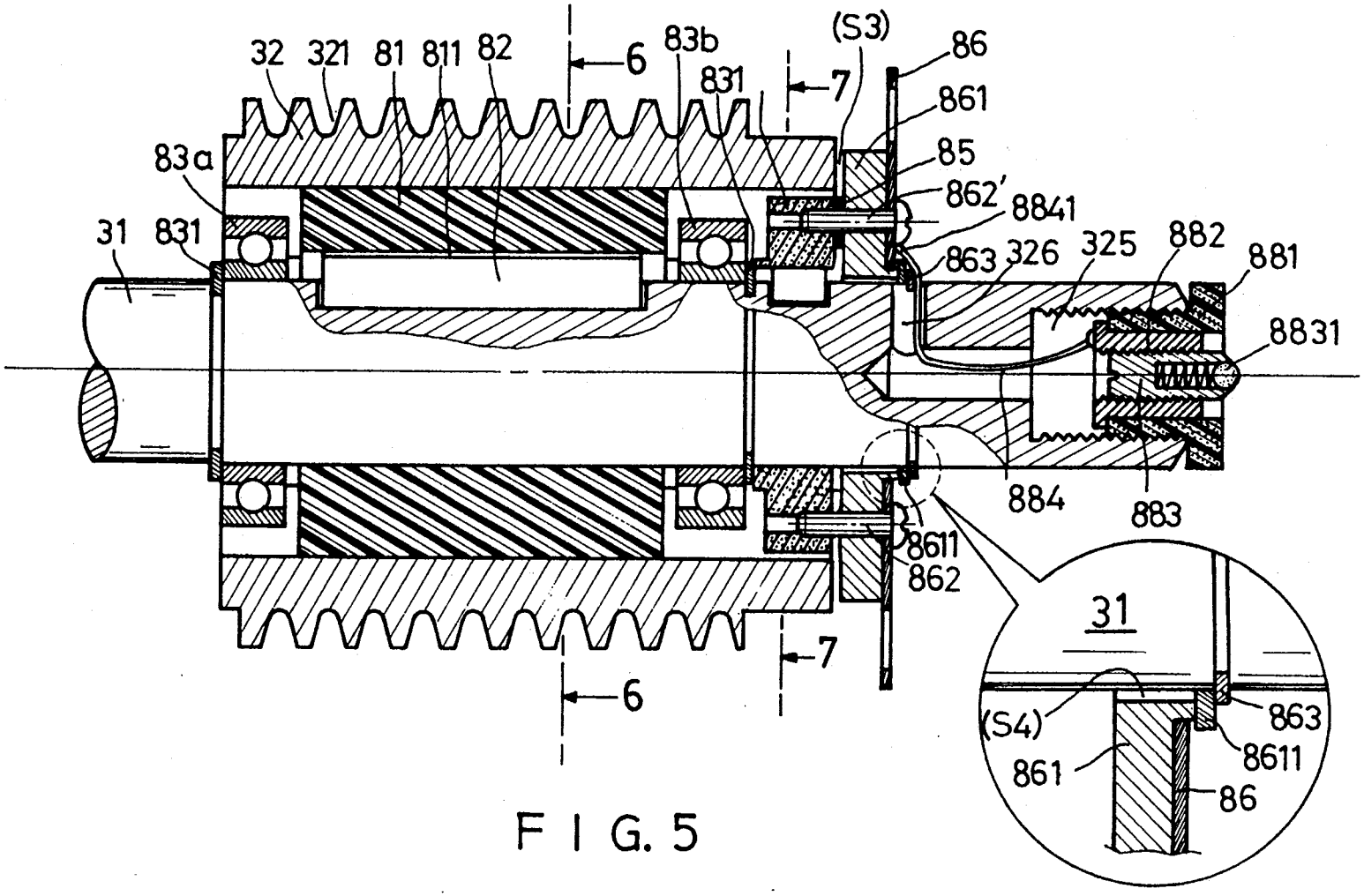
FIG. 5 is a cross sectional view along the line 5—5 of FIG. 4.
Figure 7:
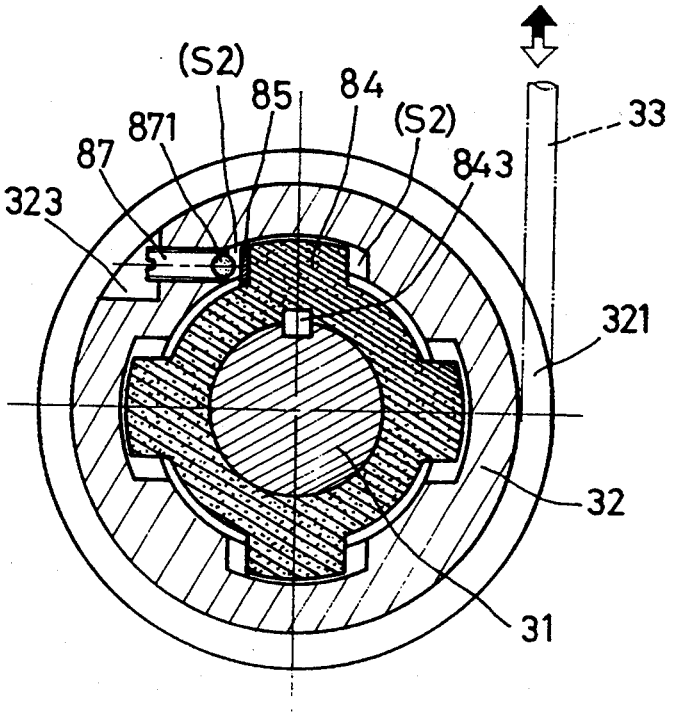
FIG. 7 is a cross sectional view along the line 7—7 of FIG. 5.

By means of the aforementioned controller circuit device, the cable 33, when pulled out by the user during low weight, will cause the winding drum 32 to rotate in reverse direction therein driving the main shaft 31 through the torque switch 8 inside the said winding drum 32 (please consult above FIGS. 5, 6, 7 for details concerning their construction and operation). Hence, the roller clutch 45 drives the timing pulley 42 thereby driving the timing belt 43 and timing pinion 41 then turning the armature of motor 11. Due to the reverse rotation of the armature of said motor 11, the motor is turned into a generator. The tension of cable 33 is controlled by control panel 65 and electronic load 62. In this case, the tension of cable 33 creates a torque greater than that of pre-set in torque switch 8 and therefore the contact point of the switch will open. When cable 33 is released by the user, said motor 11 will switch from a generator function to a motor function. The system's inertia and friction makes the cable unable to be rewound in light weight condition. At this instant, the torque of the winding drum is less than the pre-set value in torque switch 8 causing the contact point of the switch (the contact device 87 and conducting strip 85 in FIG. 7) to remain in a contact position. This enables the feedback signal is transmitted to the adder at processor 63, therein enabling the current to said motor 11 to be compensated to a level where the motor armature will accelerated rapidly. This forward torque passes in sequence through the timing pinion 41, timing belt 43, timing pulley 42 and roller clutch 45 (located inside the large timing pulley ) driving the main shaft 31 and winding drum 32 causing the slackended cable 33 to be rewound rapidly. When the torque of main shaft 31 passing through torque switch 8 to winding drum 32 is greater than the torque pre-setting, the switch contact point will open again thereby interrupting the feedback compensation current. By means of this ON-OFF response, the inertial acceleration in the system can be overcome allowing cable 33 to keep pace with the user's exercise speed and giving the user the feel and comfort of conventional weight stack systems.

Figure 11:
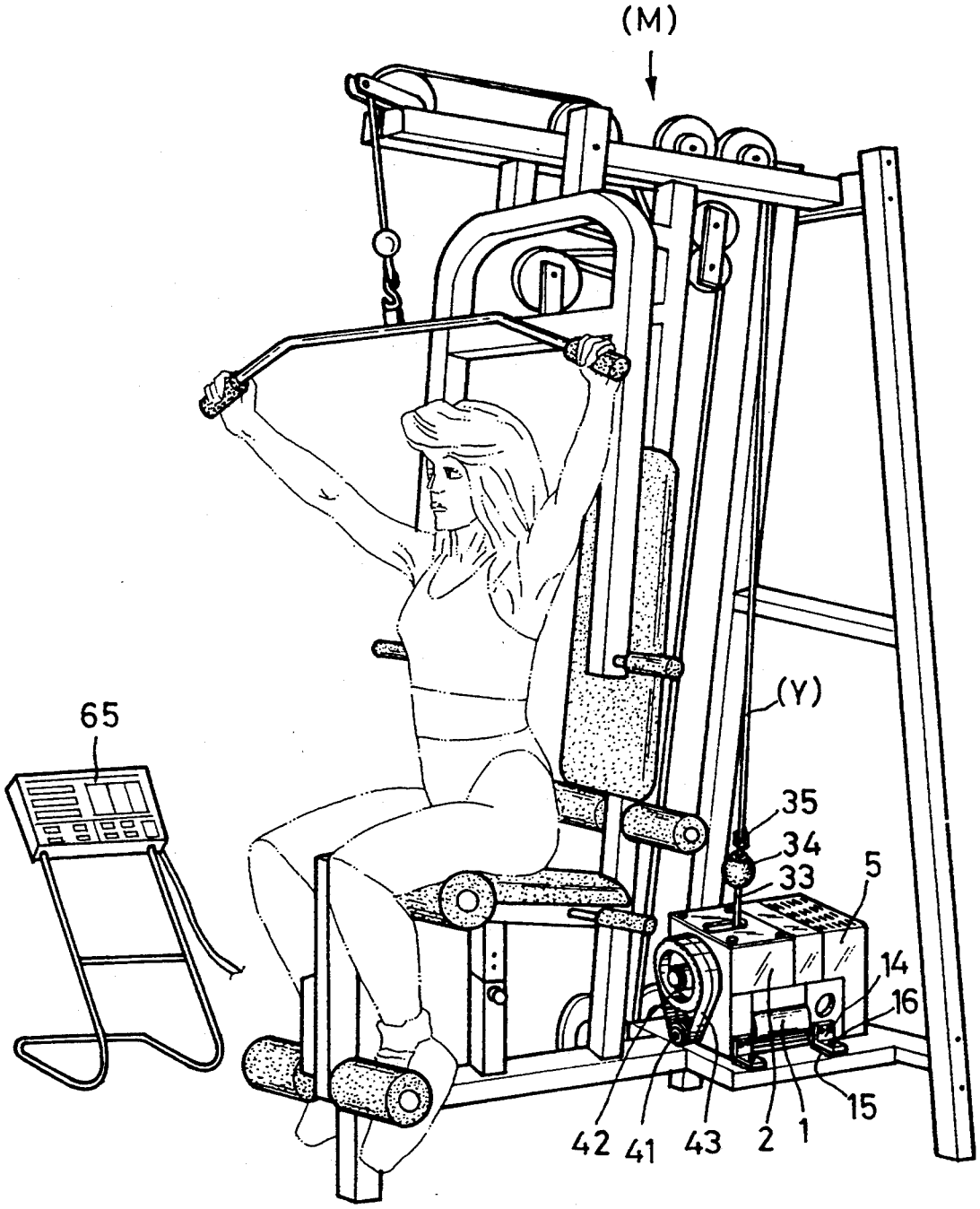
FIG. 11 is an applicaton example of the system.

FIG. 11 shows one possible application of the invention. The dynamic resistance device is incorporated on a weight trainer M replacing the conventional iron weights. As show in FIG. 2, the driving device 1 can be affixed to the trainer M using base brackets 14 and rubber cushion 15 mounted to the base of the driving device 1. The connecting ring 35 is connected to pulling cable Y and rubber ball 34 of weight trainer M. During exercise, the users pulls pulling cable Y in an upward direction, thereby pulling cable 33 on winding drum 32 producing a constant tension. Then, in accordance with the improvements made to the invention, torque switch 8 inside winding drum 32, rewinding device 9 at the rear end of main shaft 31, rolling clutch 45 positioned within timing pully 42 along with controlling circuit device 6 and other mutually combined functions, a more ideal result can be achieved. Therefore, the previous invention compared to previous inventions can enable the cable 33 quickly rewound keeping pace with the user's cable speed giving the user a better weight trainer feel. The problem of slackening in cable 33 due to power interrupt therein causing the cable 33 to slip of the spiral groove 321 of winding drum 32 has also been solved and thereby greatly improving its actual function. In addition, the year spent in making design improvement to the invention has already been rendered into a prototype and is ready for mass production and utilization by manufacturers. Although the present invention has been described in connection with preferred embodiments thereof, many other variations and modifications will now become apparent to those skilled in the art without departing from the scope of the invention, therefore, that the present invention will not be limited by the specific disclosure herein, but only by the appended claims.

What is claimed is:

1. A dynamic resistance system comprising:

a driving mechanism having a D.C. motor, a motor output shaft, a small electric cooling fan mounted on the rear of the motor, to remove heat produced by said motor;

a bracket frame mounted onto the motor by means of screw members;

a long slotted hole disposed on the stopping bracket, a shaft hole at the front of said bracket frame for the insertion of a bearing, a large round hole disposed at the rear of the said bracket frame, a rear housing mounted onto the round hole of the bracket frame by means of screw members, a shaft hole positioned at the center of said bracket frame for insertion of bearings, a small hole on top provided for insertion of slotted optical switch;

a winch mounted within the bearings of said bracket frame comprising:

a main shaft, a winding drum rotating in tandem with said main shaft, a cable affixed at one end to said winding drum and coiled around the spiral slot of said winding drum, a rubber ball affixed to said cable and passed through the free end of said long slotted hole of said stopping bracket causing the ball to stop upon the stopping bracket during rewinding;

a speed reduction mechanism comprising:

a timing pinion mounted on the said motor output shaft;

a timing pulley mounted on front end of main shaft of said winch;

a timing pulley belt disposed around said small and large pulley wheels moving in tandem with the rotation of said motor output shaft therein rotating said winch;

a control box composed of front or rear housings mounted on the rear side of said motor by means of screw members for the housing of said small cooling fan and controller circuit device, sockets at the rear side for connection of the power cord and the control cord connector;

a torque switch mounted between said main shaft and said winding drum, a rewinding mechanism mounted on rear end of main shaft, a roller clutch disposed in the inside of said timing pulley allowing the cable to keep pace with the speed of the user, better simulating a weight trainer and prevent slippage of the cable on the winding drum in any condition due to the fast rewinding of said cable.

2. The dynamic resistance system as recited in claim 1 wherein said torque switch comprises:

a cross shaped driving mechanism, a key slot disposed at the shaft hole positioning at the center of said main shaft by means of a locking key, a cross shaped body formed on the outer edges of said cross shaped driving mechanism for disposal into cross shaped slot on said winding drum, respective space reserved in between said cross shaped body and cross shaped slot, screw holes disposed on both sides of said cross shaped driving mechanism provided for the disposal of embedded screws and small springs;

a ball bearing mounted separately the front and rear ends of the stopper and positioned by means of a C shaped ring;

a cross shaped insulator disposed with a key slot disposed on the shaft hole of said insulating body positioned at the rear of said main shaft by means of locking key and space reserved between said winding drum and cross shaped slot;

a L-shaped conducting strip mounted on side edge of said insulating body;

a decoding wheel with space reserved in front of said decoding wheel thereby not coming into contact with separating ring of said main shaft mounted to insulating body by means of several screw members and one of said screw members must come into contact with said insulating body and be screwed into the top or insulating body, said separating ring extends towards the outer edges of said decoding wheel rotatively disposed with two insulating washers, said insulating washers mounted to said main shaft by C shaped rings, a space reserved between said separating ring and said winding drum;

a screw shaped contact element with a steel ball disposed at its tip mounted to rear notched recess on winding drum by screw holes allowing said steel ball of said contact element to extend into the cross shaped slot of said winding drum opposite said conducting strip on side of said insulating body;

a signal transfer device comprising of a insulating body mounted on the rear of said main shaft by screw holes, a conducting strip mounted within the insulating body, conducting elements with steel ball screwed into the screw holes on the outer edges of said conducting strip, an electric wire soldered at one end to said conducting strip and free end passed through screw hole of said main shaft extending through and out the punch hole connecting to screw at said conductng strip.

3. The dynamic resistance system as recited in claim 1 wherein said rewinding mechanism comprises:

a sleeve with a groove on the surface and mounted by means of adjustment bolts onto rear of said main shaft;

a spiral spring having inner end positioned in said groove and outer side forming a hook shape; front and rear positioning plates disposed on the front and rear of said spiral spring;

a cover mounted with stopping tab on inner side for mounting of said hook on said spiral spring;

said components are mounted onto the rear cover by means of screw hole and screw on the said cover.

* * * * *